US005251826A

United States Patent [19]

Schonbach et al.

[11] Patent Number: 5,251,826

[45] Date of Patent: Oct. 12, 1993

[54] TUMBLING MEDIA MILL AND CONTROL SYSTEM

[75] Inventors: Bernard H. Schonbach, Allentown; Charles S. Fleishman, Wynnewood, both of Pa.

[73] Assignee: Pennsylvania Crusher Corporation, Broomall, Pa.

[21] Appl. No.: 852,077

[22] Filed: Mar. 13, 1992

[51] Int. Cl.[5] ..... B02C 23/38

[52] U.S. Cl. ..... 241/19; 241/29; 241/34; 241/80; 241/152.2

[58] Field of Search ..... 241/152.2, 99.1, 80, 241/81, 34, 19, 29, 36, 52, 54, 62, 97

[56] References Cited

U.S. PATENT DOCUMENTS

| | | | |
|---|---|---|---|
| 1,575,719 | 3/1926 | Sandberg . | |
| 1,780,132 | 4/1929 | Jaedel . | |
| 2,367,548 | 4/1941 | Prouty . | |
| 2,480,085 | 8/1949 | Mitchell . | |
| 2,595,117 | 4/1952 | Ahlmann . | |
| 2,679,316 | 5/1954 | Ruepp . | |
| 2,894,696 | 7/1959 | Miller | 241/152.2 X |
| 3,078,050 | 2/1963 | Hardinge | 241/80 X |
| 3,289,950 | 12/1966 | Heming et al. . | |
| 3,329,353 | 7/1967 | Knudsen | 241/79.1 X |
| 3,794,251 | 2/1974 | Williams . | |
| 3,948,447 | 4/1976 | Jacob . | |
| 4,085,897 | 4/1978 | Hahn et al. . | |
| 4,281,800 | 8/1981 | Flavel | 241/152.2 X |
| 4,498,632 | 2/1985 | Ruter . | |
| 4,498,633 | 2/1985 | Williams . | |
| 4,681,266 | 7/1987 | Mason et al. . | |
| 4,726,531 | 2/1988 | Strasser . | |
| 4,728,044 | 3/1988 | Duill et al. . | |
| 4,840,315 | 6/1989 | Rubin et al. . | |
| 4,927,086 | 3/1990 | Henne et al. . | |
| 4,934,613 | 6/1990 | Kukuch | 241/152.2 X |
| 5,062,601 | 11/1991 | Graf . | |
| 5,076,507 | 12/1991 | Graf et al. . | |

FOREIGN PATENT DOCUMENTS

| | | | |
|---|---|---|---|
| 2620463 | 11/1977 | Fed. Rep. of Germany | 241/79.1 |
| 363525 | 3/1973 | U.S.S.R. | 241/80 |
| 1003894 | 3/1983 | U.S.S.R. | 241/80 |

*Primary Examiner*—Mark Rosenbaum
*Assistant Examiner*—Frances Chin
*Attorney, Agent, or Firm*—Pollock, Vande Sande & Priddy

[57] ABSTRACT

Prior to entering a tumbling media mill grinding chamber, feed containing clumps of adherent fine and coarse particles is brought into jarring contact with a moving member for liberating fine particles. Liberated fines are contacted, outside the chamber, with a current of gas to remove them from the remainder of the feed. At least a portion of this remainder enters a bed of charge material in the chamber and is ground with the media. When an indicator of a developing or existing over-fed or under-fed condition in the bed is sensed, adjustment of the jarring intensity, of the gas velocity or of both is made in response to the indicator for increasing and decreasing the quantity of fine particles removed from the feed. A clump separator, having an enclosure, jarring member and coarse solids outlet, may be used to liberate fines. This outlet is connected with a coarse solids inlet to the chamber. A path other than the coarse solids outlet is provided for removing liberated fine particles from the enclosure. A control, responsive to the indicator, increases and decreases the quantity of fine particles removed via this path. Preferably the enclosure is a duct, the jarring member rotates in the duct, the member is below and spaced from a duct feed inlet through which the duct receives the feed, and an entrainment gas supply conduit is connected with the duct for maintaining an upwardly flowing gas current through the jarring member and beyond the duct solids inlet.

42 Claims, 2 Drawing Sheets

TUMBLING MEDIA MILL AND CONTROL SYSTEM

TECHNICAL FIELD

The invention relates to tumbling media mills and control systems for such mills which adjust characteristics of feed material and which may also adjust characteristics of the charge undergoing grinding in the mill.

BACKGROUND OF THE INVENTION

Many tumbling media mills (TMMs) are in use with such grinding media as balls, slugs, rods, tubes and the like. Although high in power consumption, TMMs offer a number of advantages. As compared to hammermills, granulators, jaw crushers, multi-roll mills and other grinding and crushing equipment, TMMs more readily handle a wide range of soft to very hard materials and grind them to very fine products. TMMs are also rugged in construction, simple to operate, and withstand the ravages of abrasive materials and uncrushable objects. This is why TMMs are popular for applications in which the feed stream contains uncrushable tramp materials or is very abrasive, and in which simple operation is desired more than low specific power consumption.

A typical feeding arrangement for a TMM is a weigh conveyor controlled by a feed-back loop from sensors selected and located to measure whether the mill is being over- or under-fed. Such sensors as microphones to "listen" to the sound of the mill and/or current measuring equipment to monitor the load on a product conveyor at the mill solids discharge outlet have been used.

Grinding efficiency has been a major goal in the design and operation of other types of grinding equipment. However, in a TMM, because the weight of the tumbling bed of media in the grinding chamber greatly overshadows the weight of material undergoing grinding at any given time in normal operation, TMMs typically operate within a narrow range of efficiency, leaving little apparent opportunity to benefit from major efforts at improving efficiency.

Intelligent and knowledgeable operators can usually tell if a TMM is significantly over- or under-fed by listening at specific points on the mill shell. However, efficiency of mill operation cannot be determined easily or in "real time" measurements. Data must be collected on the feed material size and hardness, product size distribution, presence of moisture, power measurements, and other circuit parameters. These facts must be evaluated together to give a resultant system efficiency.

Such efforts as have been made to increase efficiency through improved TMM apparatus and operating methods have mainly focused on providing a strong current of air through the grinding chamber to sweep as much as possible of the finest material out of the bed as soon as possible. Also, heating the air is of assistance in drying the bed, its contents and the recovered fine particles when the feed is moist.

There is a need for improvements in the design of TMM feeding and control systems to provide for removal of product size particles from the feed stream, particularly particles of substantial moisture content, before the material enters the mill. Also, there is a need to control the feed stream into the TMM to maximize the ability of the TMM to crush and grind more efficiently. The present invention fulfills these needs and others, as will become clear from the description of the invention and of various embodiments thereof which follows.

SUMMARY OF THE INVENTION

In one of its aspects, the invention provides a method of operating a tumbling media mill, comprising creating a charge of particulate material in a tumbling media mill grinding chamber by introducing a continuing flow of particulate material into said chamber. This charge is ground by rotating the chamber to cause tumbling action in a bed of grinding media in the chamber and thereby cause grinding action between the media and the charge in the bed. Prior to its entry into the chamber, a feed containing clumps of adherent particles of relatively fine and coarse particle size is brought into jarring contact with a moving member at a selected jarring intensity for liberating fine particles from the clumps. The liberated fine particles are brought into contact, outside the chamber, with a current of gas for removing a controlled proportion of the finer particles from the remainder of the feed. All or a portion of the remainder of the feed is directed into the grinding chamber and ground as a component of the charge in the bed. When at least one indicator of a developing or existing over-fed or under-fed condition in the bed is sensed, the jarring intensity or the velocity of the gas current or both of them is or are adjusted in response to the indicator(s) for increasing and decreasing the quantity of said finer particles removed form the remainder of the feed.

In a second aspect, the invention provides apparatus for treating particulate solids, comprising a tumbling media mill having a grinding chamber rotatable to tumble a bed of grinding media and particulate solids, a solids inlet and a solids outlet. This aspect of the invention further comprises a clump separator for receiving and preparing feed material to be ground in the tumbling media mill grinding chamber. The clump separator includes an enclosure, at least one jarring member and a coarse solids outlet. At least part of the jarring member extends into the enclosure for moving in the enclosure and has at least one material contacting component for jarring at a selected jarring intensity a feed comprising clumped relatively fine and coarse particulate solids and for liberating fine particles from the clumps. The coarse solids outlet is connected, directly or indirectly, with the tumbling media mill grinding chamber solids inlet for delivering coarse particulate solids to the chamber. Means are also provided for removing liberated fine particulate solids from the enclosure by a path other than the coarse solids outlet. At least one indicator means is provided for sensing a developing or existing over-fed or under-fed condition in the bed. Moreover, there is at least one means responsive to the indicator means for increasing and decreasing the quantity of fine particles removed from the enclosure via said path.

In yet another of its aspects, the invention includes additional apparatus for treating particulate solids. Such apparatus includes a tumbling media mill having a grinding chamber rotatable to tumble a bed of grinding media and particulate solids, a solids inlet and a solids outlet. An elongated entrainment duct is also provided to receive a feed of relatively fine and coarse particulate solids, including clumps comprising said fine and coarse solids, and to prepare therefrom a charge to be introduced into the tumbling media mill chamber to be ground therein. This duct has a solids inlet for said solids. Another feature of this clump separator is a jarring member, at least part of which is positioned in the duct, which part is positioned in a portion of the duct which is spaced apart from and below the solids inlet, to receive said solids by gravity descent from the solids inlet and to separate fine and coarse solids from said clumps. The clump separator includes means for increasing and decreasing the jarring intensity of the jarring member for adjusting the proportion of fine particles liberated from the clumps. At least one entrainment gas supply conduit has a connection with the duct, this connection being positioned in the duct and spaced apart from and below the solids inlet. At least one means is connected with the conduit for maintaining an upwardly flowing gas current through that portion of the duct which includes said part of said jarring member and through that portion of the duct which includes the solids inlet, for causing gravity descent in the duct of clumps from the solids inlet and of coarse particles from the jarring member, for entraining in the duct fine particles liberated from the clumps by the clump separator, for lifting the liberated fine particles int he duct toward the solids inlet, for bringing other fine particles of feed into entrainment with the liberated fine particles adjacent to the solids inlet and for lifting the resultant mixture of liberated and other fine particles above the solids inlet.

DESCRIPTION OF VARIOUS EMBODIMENTS OF THE INVENTION

Figure 1:
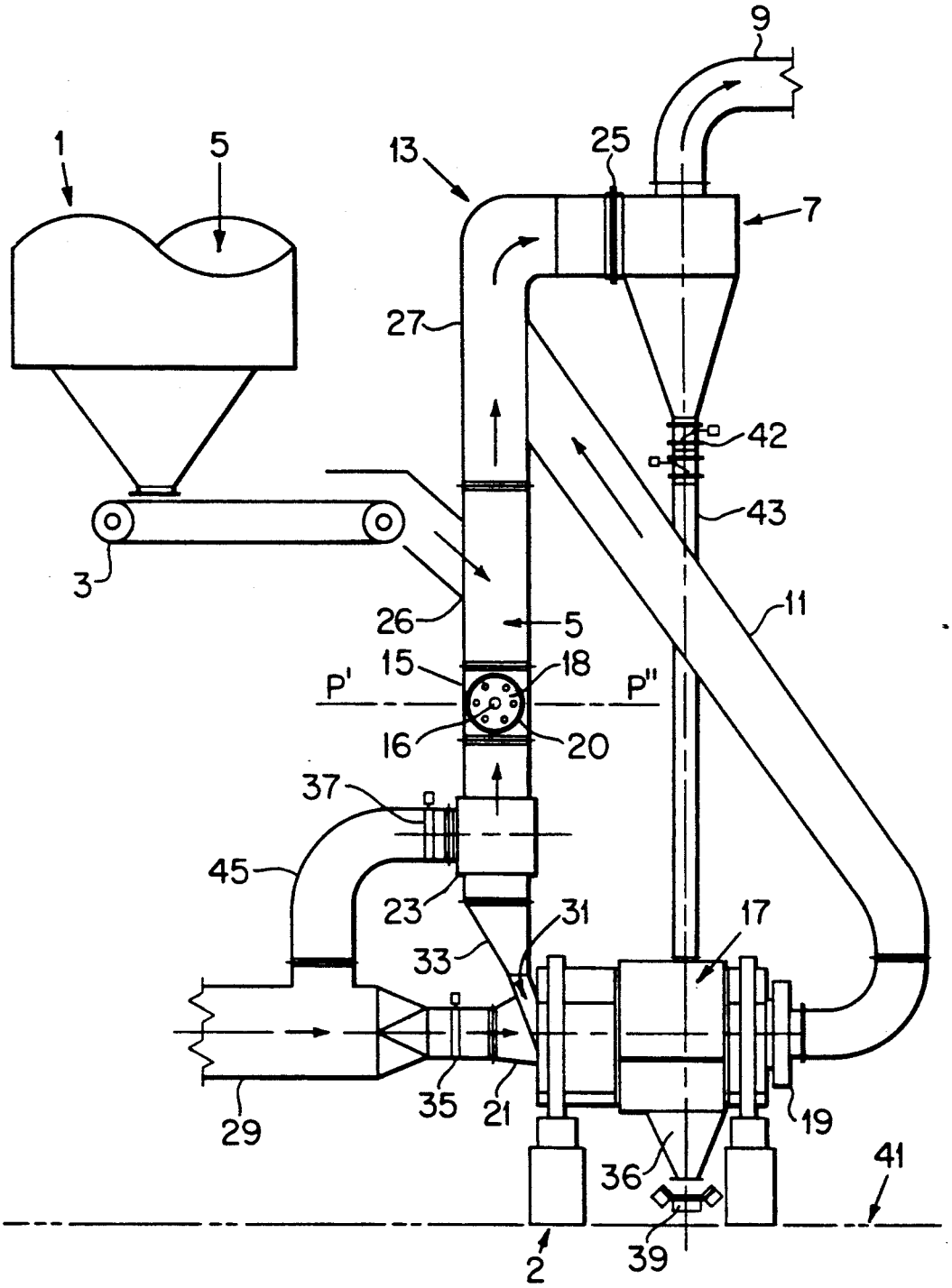
FIG. 1 is a partly schematic side elevation of apparatus according to the invention.

Although the invention may be embodied in many different ways, the present illustrative embodiment of the invention disclosed in FIG. 1 comprises a controllable feeder, a riser, a clump separator, a mill, and a gas supply system. These components are described below.

The controllable feeder may be any device capable of feeding particulate material to the riser at a controlled rate. In this embodiment the feeder includes a storage container, such as bin or silo 1, and a delivery means such as drag conveyor 3. These components, along with the riser, clump separator, mill, and gas supply system are all mounted within and/or supported by a suitable superstructure (not shown) on a floor or earthen support 41. Conveyor 3 transfers particulate material 5 from silo 1 into the riser.

The invention employs an entrainment enclosure, a device for gas separation of particulate material of differing size and/or mass, which may be embodied in a wide variety of forms. It typically includes a chamber, preferably a duct, in which certain the particles are entrained in gas for separation from the other particles. Such duct may for example have a circular, rectangular or other shape in transverse cross-section.

The present embodiment of the entrainment enclosure is a substantially vertical riser 13. Non-vertical orientations may however be used, including horizontal. However, devices in which the flow of solids is more nearly vertical than horizontal have the advantage of more readily promoting multiple impacts between the solids and the clump separator, as described below.

Riser 13 has a gas inlet 23, a gas outlet 25 and a material inlet 26. Inlet 23 is connected to a gas source, such as a blower (not shown) and furnace (not shown) to supply a flow of air or heated air, through gas duct 29, riser branch duct 45 and a flow adjuster such as damper 37. Outlet 25 is attached to a material collector which may be for example a cyclone separator 7 or a series of cyclone separators. Material inlet 26 is configured to introduce particulate solids 5 into riser 13 while inhibiting or preventing escape of an ascending gas current in the riser.

Below inlet 26, riser 13 is configured to cause material entering the inlet to be drawn downward by gravitational forces in a countercurrent relationship with the ascending gas current. Finer particles, depending on their mass and the velocity of the gas, will be entrained and be carried upward in the gas stream into material collector 7. Coarser particles of sufficient size and weight not to be entrained will continue downward into the clump separator.

This clump separator may be any device suitable for dislodging or separating clumped relatively fine and coarse particulate solids from one another. It may be located in the riser, intermediate its gas and solids inlets, or outside the riser in a channel leading to the riser solids inlet. Arrangements are possible in which there are clump breakers in series, or both inside and outside the riser. However, it is preferred that there be at least one clump breaker positioned along the vertical length of and below material inlet 26 of riser 13.

Although various types of crushers might be employed for this purpose, it is preferred to use equipment which limits the extent to which the ultimate particles in the clumps are crushed. Preferably the device jars the particulate solids without effecting major reduction in the sizes of the ultimate particles. Such device may have any suitable form, examples of which include rotary cages, paddle wheels, hammer-mills and other forms. According to a particularly preferred embodiment the clump breaker has moving members capable of applying a controlled jarring action to the clumps, such that the ultimate particles represented in a given sample of the feed prior to exposure to the member suffers no more than 25% reduction in weight of ultimate particles in any fifth part of the total particle size range represented in the sample.

The present embodiment employs a rotary cage clump separator 15 shown in FIG. 1, the term "cage" referring to the fact that the clump separator rotor is similar to the rotors employed in certain cage mills. It includes a rotatable central drive shaft 16 having two axially spaced disks 18 fixedly secured thereon. An array of elongated, bar-like jarring members 20 of round or other suitable cross-section is supported between the disks. Each jarring member has one of its ends fixed to one of the disks, with the members oriented parallel to the longitudinal axis of the drive shaft and at a uniform radius from that axis. In this embodiment, the combination of jarring members and disks fills substantially the entire cross-section of the riser 13, with the drive shaft axis being perpendicular to the longitudinal axis of the riser.

Clumps of particulate material 5 which enter clump separator 15 are separated into various pieces including relatively finer and coarser particles. Liberated fine particles are carried upward in the ascending gas current, combine with other fine particles at the material inlet 26 and continue to cyclone 7.

Cyclone 7, connected to riser outlet 25, serves to separate the finer particles from the upward flowing gas stream in which they are entrained. The recovered gas may be recirculated or vented to the atmosphere. Draft for cyclone 7 is provided by fan inlet duct 9 connected through a fan (not shown) to an atmospheric vent (not shown). The recovered fine particles may be combined with product from the mill, as discussed below, or may be otherwise used or disposed of. Coarser particles, that pass through or around the clump separator 15, continue their travel down the riser, passing through riser gas inlet 23 into riser/grinding chamber connection 33 and into the tumbling media mill for additional processing and size reduction.

Tumbling media mills are well known to those skilled in the art, and they may for instance have grinding chamber cross-sections that are cylindrical or not cylindrical, including circular, polygonal, irregular or other shapes, in which a bed of media of one or more shapes, including balls, slugs, tubes, rods and other shapes, are tumbled by rotation of the chamber to grind a charge of particulate material in the bed. A preferred mill is disclosed in Graf, U.S. Pat. No. 5,062,601, the disclosure of which is incorporated herein by reference. Rolls, that is, rods or tubes, are the preferred media. See for example Graf, U.S. Pat. No. 5,076,507, the disclosure of which is also incorporated herein by reference.

Mill 2 of the present embodiment has within it a grinding chamber, the location of which is generally indicated by arrow 17. This chamber is rotated with the aid of power means, such as chain sprocket 19, as well as a drive chain (not shown) and a sprocket-equipped motor (not shown). Chamber 17 has a solids inlet 31 to receive the coarser particulate material from riser 13 via riser/grinding chamber connection 33, as well as a gas inlet 21 to receive gas through gas supply conduit 29 and a flow adjuster such as damper 35. Gas entering through inlet 21 provides a gas draft through chamber 17 for sweeping fine particles out of the bed. These particles may be discharged from the chamber in any desired manner, and used or disposed of as desired. For example, the particles may be discharged axially via chamber vent duct 11, which conveys the draft gas and particles into the riser for separation in cyclone 7. Alternatively, duct 11 could be connected to a second material collector independent from collector 7. If the chamber 17 has peripheral discharge outlets and a surrounding screen, as in Graf's above-identified patent, these particles may be discharged from the perimeter of the chamber and through the screen, followed by delivery to a cyclone or other destination.

In the present embodiment, the flows of both particulates and gas through chamber 17 are generally from left to right. However, it is not necessary that the particulate material and the gases supplied through gas supply conduit 29 enter the same end of the grinding chamber 17. It may be beneficial, given specific mill configurations and materials processed, to establish countercurrent flows between the particulate material and the gases.

In this embodiment, the gases which pass through riser 13 and grinding chamber 17 come from a common gas source via gas supply conduit 29, being divided and fed through a "Y" into riser branch duct 45 and mill gas inlet 21. However, the riser and grinding chamber may be fed separately from any number of gas sources. Thus, dampers 35 and 37 can be supplied through separate or multiple gas supply conduits, and different types of flow control devices can be substituted for the dampers. If the "Y" arrangement is retained, the gas flow control function of dampers 37 and 39 may be performed by a damper or other type of valve, such as a fluidic valve, at the junction of the "Y."

In this preferred embodiment, chamber 17 has peripheral discharge outlets (not shown) and a surrounding screen (not shown), as in Graf's above-identified patent. Those larger product particles which are not swept into duct 11 by the gas draft from inlet 21 are discharged from the perimeter of the chamber into and through the screen, and fall into the bottom of a surrounding product collection hopper 36 for discharge onto product conveyor 39.

Solids outlet 42 of collector 7 includes air lock means, such as a plate or star feeder, to prevent excessive escape of gas through this discharge. By intermittently opening this outlet, fine particulates recovered in cyclone 7 may be directed through duct 43, which passes down behind mill 2, for discharge onto product conveyor 39.

When the system of FIG. 1 is in operation, the riser 13 and clump separator 15 can cooperate to control and adjust the apportionment of the relatively fine particles in the feed between the grinding chamber 17 and the riser gas outlet 25. This includes both free fine particles in the feed and those relatively fine particles liberated from clumps by the clump separator.

In the present embodiment of the invention, the grinding chamber is pneumatically isolated, at least partly, from riser 13. This is because riser/grinding chamber connection 33, which extends between the riser and the grinding chamber and conveys particulate solids from the riser to the chamber solids inlet 31, tapers down to a substantially smaller cross section than the riser. Thus, when the flow cross-section through damper 37 is increased or decreased, there is a corresponding increase or decrease in the volumetric flow rate and the velocity of the gas current entering and passing upward through riser 13. More of any increased flow will go up the riser than will proceed down through connection 33 and inlet 31 into the grinding chamber. Further isolation can be obtained by operating the system so there is some hold-up of solids in the connection 33, further inhibiting passage of gas from the riser into the grinding chamber.

Increasing the gas current velocity in the riser tends to increase the proportion of relatively finer particles of feed entrained in the gas current. These pass upwardly in the riser through its upper portion 27 and outlet 25 into cyclone 7. There is a corresponding decrease in the proportion of fines discharged downwardly from the clump separator 15 and passed through the lower portion of the riser and inlet 31 into the grinding chamber. Thus, opening damper 37 wider, with an accompanying increase in the velocity of the gas current in the riser, can be employed to reduce the quantity of fines reaching the grinding chamber, such as to remedy or prevent an over-fed condition. On the other hand reducing the opening through damper 37, with an accompanying decrease in the velocity of the gas current in the riser, can be used to increase the quantity of feed material reaching the grinding chamber, such as to remedy or prevent an under-fed condition.

When the clump separator fills a sufficient portion of the cross section of the enclosure in which it operates, including a riser or other form of duct, it can provide an alternative or additional form of control over the apportionment of fines between the riser gas outlet and the grinding chamber. For this purpose, it is preferred that the material contacting component(s) of the clump separator should sufficiently fill the cross section of the enclosure in which it operates, for substantially impeding the flow of particulate material through and/or around said member.

In a preferred embodiment, such component(s) traverse a predetermined volume or volumes of the space within the enclosure, and the total area of such volume or volumes, when projected upon a plane perpendicular to the overall general direction of motion of material through the enclosure, is equivalent to at least the majority of the area of the cross section of that part of the enclosure through which the member moves. The enclosure cross section just mentioned is of course also perpendicular to the overall direction of material movement. According to particularly preferred embodiments the projected total area of such volume or volumes is equivalent to at least about 80% or more preferably about 90% and still more preferably substantially all of, the area of said enclosure cross section, as is illustrated at plane P'-P" of FIG. 1.

In the embodiment shown in FIG. 1, the enclosure is a riser, the clump separator is a rotor and the material contacting components are the bar-like jarring members 20. The projected area of the volume traversed by these jarring members occupies enough of the enclosure cross section so that the bar-like members are able to impede downward flow of material through the clump separator and upward flow of the gas current in the riser. Increasing and decreasing the speed of jarring members provides another form of control over the apportionment of fine particles between the riser gas outlet and the grinding chamber.

Speeding up the clump separator increases jarring intensity as well as the difficulty with which solid material passes down through the separator and the difficulty with which gas passes upwardly through it. Increasing the jarring intensity increases the average number of fine particles liberated, per impact, from each clump. Increasing the difficulty of passing solid material down through the clump separator increases the average number of impacts to which clumps are subjected before they escape the clump separator in their downward motion. Thus a greater proportion of the relatively fine particles bound in clumps can be liberated.

On the other hand, increasing the difficulty of passing the gas current upwardly through the clump separator tends to reduce the ability of the gas current to transport finer particles upwardly in the riser. Although increased retention of material above the clump separator may afford an additional opportunity for material to be caught up in the gas current, it may still be desirable or even necessary to increase the upward velocity of the gas current when increasing the speed of the clump separator. On the other hand, if the gas current velocity is not increased, an increase in the speed of the clump separator may make it desirable or necessary to increase the velocity of the gas draft through the grinding chamber.

In the embodiment shown in the drawings, in which a common gas conduit 29 provides gas for both the gas current in the riser and the gas draft through the grinding chamber, the velocities of the current and draft are not totally independent from one another. Assuming conduit 29 is connected to a conventional blower, if one increases the gas velocity in riser 13 by opening damper 37 further, other conditions remaining the same, there will be a coincident reduction in the velocity of the gas draft through damper 35 and grinding chamber 17. An opposite reaction occurs upon reducing the opening through damper 37. Similar reapportionments of gas flow can be effected by keeping damper 37 fixed while opening and closing damper 35 or by coordinated movements of the two dampers. Thus, although supplying gas for the gas current and the gas draft through a common supply conduit 29 permits different gas velocities to be applied in the riser and the grinding chamber, these velocities are interdependent and only partly independent in the configuration shown.

However, if it is desired to exercise more independent or fully independent control over these velocities, it may be accomplished in a variety of ways. For example, using the same arrangement of conduits and dampers shown, controls may be provided to increase or decrease blower output when either of the dampers 35 or 37 opens or closes. In the alternative, the riser and grinding chamber may be provided with their own individual blowers and supply conduits, providing separate and independent gas feeds to dampers 35 and 37, so the velocities of the riser gas current and the grinding chamber gas draft may be fully independent from one another.

Thus, the mill circuit of FIG. 1 provides considerable flexibility in the distribution of feed material into the tube mill and the drying duct. Several modes of control are available which can be combined in a variety of ways, only a few of which will be mentioned, to give a wide range of control over the quantity of fines delivered to, retained in and removed from the grinding chamber.

First, the speed of the clump separator can be adjusted to provide flow resistance to the downward flowing feed stream. A higher rotor speed will retard the flow and cause more breaking up and separating of fine and coarse particles. At the same time, as material is being held up, it is also being presented to the upward flowing gas current in the riser, making it more available to be entrained in the current.

Second, one can control the quantity and the distribution of gas volume to both the riser and the mill. As the velocity in the riser decreases, more material is able to fall through the clump separator and into the mill. Many combinations of clump separator rotor speed and gas velocity exist that may yield a similar desired result.

If, for example, the mill becomes over-fed and full, the mill system operator may elect to increase the clump separator speed and increase the gas flow through the riser. This would be aimed at forcing more material to go upward while allowing the mill to clear. Alternatively, more air volume could be diverted to the mill to aid in clearing congestion in the grinding chamber.

If the mill begins running empty, the rotor speed could be reduced to allow more particulate solids to flow into the mill. The riser gas volume could also be reduced to promote more downward material flow. A lightly filled mill consumes almost the same power as one that is filled except that very little work is being done. The grinding media are also subjected to increased wear and breakage.

Third, selections of different volumes and velocities for the gas draft through the mill can be made. These can be employed in combination with adjustments of riser gas volume and velocity as well as clump separator speed in an effort to keep mill running efficiency as high as possible. These several measures provide almost an infinite variety of operating modes to the mill operator. Although these selections and adjustments can be done manually, the invention lends itself well to automatic control. Automation can be provided to control the dampers and flow into the riser and grinding chamber and to control the speed of the clump separator rotor. Microphone devices can be employed around the mill shell to sense conditions in the grinding chamber and give signals to control the dampers and rotor when action is required. The product conveyor under the tube mill can be a weigh scale conveyor which can provide a signal to a programmable controller. An automatic control system is illustrated below.

Figure 2:
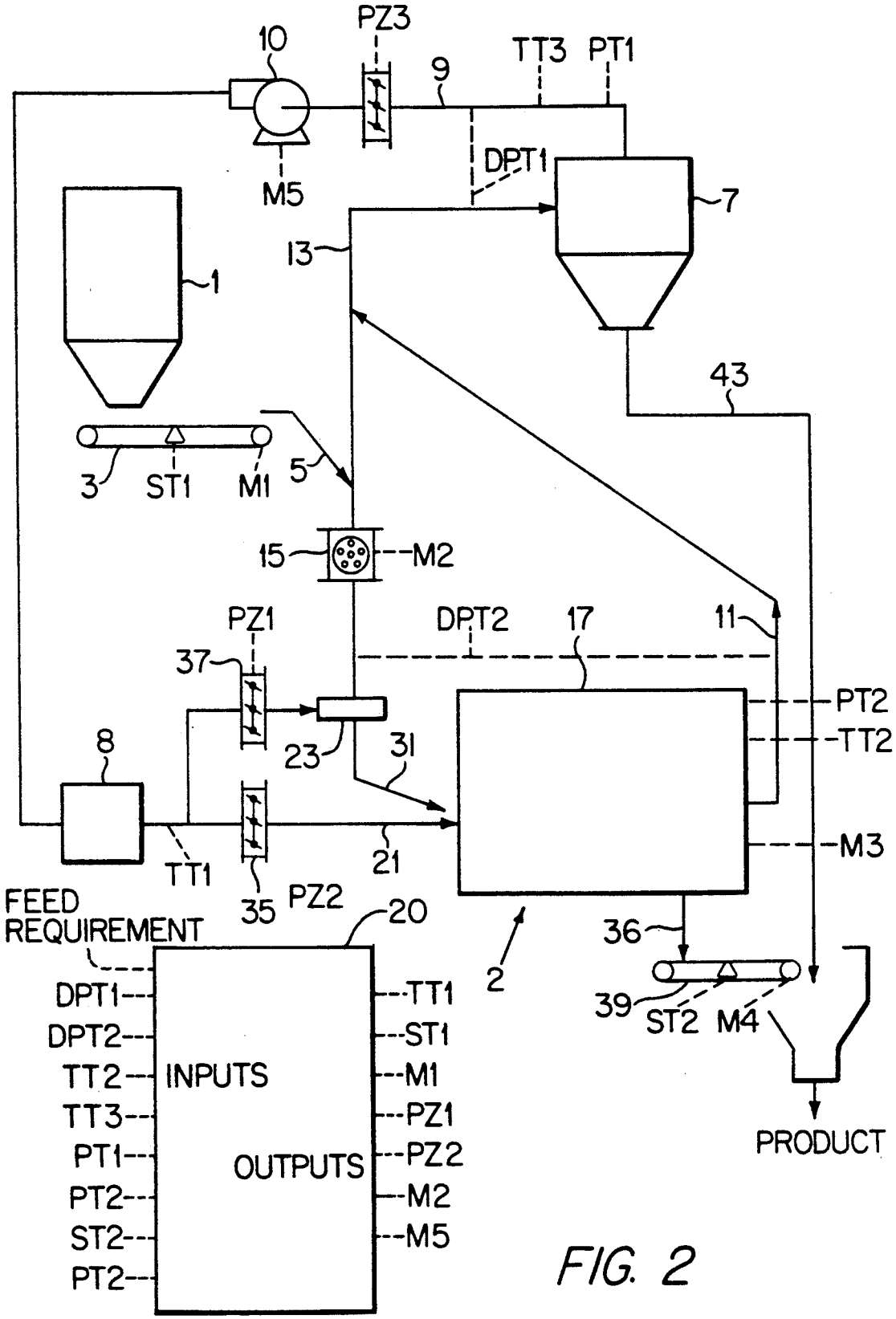
FIG. 2 is a schematic diagram of a system comprising the apparatus of FIG. 1 and equipment for sensing conditions within the system and semi-automatically or automatically controlling system operation.

An automatic control system for the present invention is shown schematically in FIG. 2. A programmable computer can be used to monitor conditions at various locations in the system, for example motor speeds, pressures, weights and temperatures. These can be used to automatically control gas flow through riser 13 and grinding chamber 17, as well as other aspects of the operation of the mill and its related components.

Feed storage silo 1 in combination with feeder 3 transports particulate material into riser 13. Silo 1 would typically include a level monitor to signal its inventory, or could be mounted on load cells for continuous load read out. Feeder 3 is typically a belt feeder and can comprise a scale with transmitter sensor ST1 for measuring particulate material and a variable speed motor with motor speed control M1. A control means which may be for example a programmable computer 20 controls the rate of feed from silo 1 into riser 13 by monitoring scale transmitter sensor ST1 and adjusting motor speed control M1. Computer 20 further controls clump separator 15, varying the motor speed M2 to aid in increasing or decreasing material flow to grinding chamber 17.

The hot or cold gases which provide the upward current of riser gas and the draft gas through the grinding chamber to liberate and sweep out fine particulate material, are controlled by computer 20 using any suitable control means, which may be for example pneumatic damper positioners PZ1 and PZ2. Computer 20 monitors the gas pressure and velocity in the riser and mill and then signals the positioners PZ1, PZ2 and PZ3 as well as motor M5 of fan 10, to adjust the flows in the system, riser and mill.

The temperature of the gases entering and passing through the riser 13 and the grinding chamber 17 are also monitored by computer 20 through temperature sensors TT1, TT2 and TT3. With this information, computer 20 can appropriately adjust a control (not shown) on heater 8.

In addition, computer 20 is provided with an input from differential pressure transmitter DPT2 for monitoring the pressure difference between mill gas outlet in vent 11 and the riser 13. By monitoring DPT2, computer 20 can for example detect starving or clogging of the mill and, depending on mill conditions, increase feed rate (e.g., increase motor speed M1, decrease motor speed M2 and/or reduce upward air flow through riser 13 by controlling PZ1) or decrease feed rate (e.g., decrease motor speed M1, increase motor speed M2 and/or reduce upward air flow through riser 13 by controlling PZ1) accordingly.

Grinding chamber rotational speed is controlled by computer 20 with appropriate variations on motor speed M3. This may be done in conjunction with the feed rate controls discussed above.

The mill components described above and shown in FIGS. 1 and 2 combine to provide increased efficiency in tumbling mill operations. More particularly, mill 2 utilizes separately controlled gas currents through riser 13 and grinding chamber 17. This allows computer 20 and/or an operator to separately control feed rate and particulate material size distribution of the feed to chamber 17. As the quantity of gas passing through riser 13 increases, the gas velocity in riser 13 also increases proportionally. Increased gas flow in riser 13 partially obstructs material flow through clump separator 15 which ultimately reduces the quantity of particulate material flowing to chamber 17. In addition, if the gas current is serving to reduce the moisture content of the particulate material, the increased gas flow enhances moisture reduction. Alternatively, a decreased gas flow in riser 13 increases the feed rate to chamber 17 but will remove lesser percentages of moisture in the particulate material.

In addition to separately regulating the gas flows to riser 13 and chamber 17, computer 20 and/or the operator can adjust the rotary speed of clump separator 15 to provide flow resistance to the downward flowing material stream 5. Increasing rotor speed retards material flow, thereby increasing material contact time with clump separator 15. The increased contact time in riser 13 increases material exposure to the upward flowing gas currents. The additional exposure time increases the percentage of fines entrainment in the upward gas stream and, as above, if the gas stream is serving the dual purpose of transporting fines to collector 7 and drying particulate material 5 prior to it entry into grinding chamber 17, the additional exposure of the material in riser 13 also reduces the moisture content.

To illustrate, if chamber 17 becomes overfed, computer 20 and/or the mill operator may elect to, 1) increase clump separator speed thereby impeding material flow, 2) increase gas flow through riser 13 also impeding material flow and additionally removing a larger percentage of fines and larger particles, or 3) increase the gas flow through chamber 17 to remove excess material; in addition, any of the above choices may be combined to sufficiently allow chamber 17 to clear. If on the other hand, the mill begins running empty, clump separator rotor speed can be reduced to allow more feed to flow into chamber 17, or the gas flow passing upward in riser 13 can be reduced to increase material flow to chamber 17. Alternatively or in addition, gas flow through the grinding chamber 17 can be reduced (independent of riser gas flow) thereby increasing fine particulate material in chamber 17, hence, the overall combined particulate material in chamber 17.

Since a lightly filled mill consumes almost the same power as one that is filled, with the disadvantage that very little work is being done and the grinding media is subject to increased wear and breakage, it is critical to mill efficiency to control the necessary parameters, either independently or in combination that effect mill feed; both size and rate of particulate material.

ADVANTAGES

The invention, as broadly described above, may take a variety of specific forms or embodiments, each having its particular combination of advantages. Thus, a given embodiment of the invention may provide one or more or any combination, but not necessarily all, of the following advantages. For example, the invention can disagglomerate incoming feed material, particularly with increased feed moisture, such that the finer product-size fraction can be removed prior to entry into the TMM. Some embodiments may lower the capacity requirement of the TMM. Others can reduce the overall mill power, contributing to improved mill system efficiency. Improved drying during disagglomeration can also improve the operating performance of the TMM. The spinning rotor provides improved contact between wet feed material and the gas current in the riser. When the gas is heated, such improved contact facilitates drying of the feed material and contributes to the efficiency of the mill, not only by conditioning the charge in such a way that it is more readily ground by the tumbling media, but also by facilitating early removal of the dried fine particles from the charge under the influence of the gas draft. The clump separator gives the added advantage of allowing the operator to increase or decrease rotor RPM, depending on gas velocity and material feed rate, to aid in maintaining a constant feed rate to the grinding chamber, including slowing the feed rate to a clogging mill or increasing the flow rate to a starving mill. Other advantages will be apparent to those skilled in the art from consideration of the foregoing disclosure and from operating embodiments of the invention.

We claim:

1. A method of operating a tumbling media mill, comprising:

A. creating a charge of particulate material in a tumbling media mill grinding chamber by introducing a continuing flow of particulate material into said chamber, B. grinding said charge by rotating said chamber to cause tumbling action in a bed of grinding media in said chamber and thereby cause grinding action between said media and said charge in said bed, C. bringing a feed containing clumps of adherent particles of relatively fine and coarse particle size into jarring contact with at least one moving member, prior to entry of the feed into said chamber and at a selected jarring intensity, for liberating fine particles from said clumps, and bringing the liberated fine particles into contact with a current of gas for removing a controlled proportion of the finer particles from the remainder of the feed outside the chamber, D. directing all or a portion of the remainder of the feed into the grinding chamber and grinding the feed as a component of said charge in said bed, E. sensing at least one indicator of a developing or existing over-fed or under-fed condition in said bed, and F. increasing and decreasing the quantity of said finer particles removed from the remainder of the feed by adjusting at least:

1. the jarring intensity, or 2. the velocity of said gas current in response to said at least one indicator.

2. A method of operating a tumbling media mill according to claim 1 including jarring the clumps, in an enclosure through which they move, employing said at least one moving member having at least one material contacting component sufficiently filling the cross-section of the enclosure for substantially impeding the flow of particulate material around said member in said enclosure.

3. A method of operating a tumbling media mill according to claim 2 wherein said at least one material contacting component, when moving in said enclosure, traverses at least one predetermined volume of the space within the enclosure, and the total area of the volume or volumes so traversed, when projected upon a plane through said enclosure in which said jarring member is located, said plane being perpendicular to the overall direction of motion of material through the enclosure, is equivalent to at least the majority of the total cross-sectional area of the enclosure in the same plane.

4. A method of operating a tumbling media mill according to claim 3 wherein the projected total area of such volume or volumes is equivalent to at least about 80% of the area of said enclosure cross-section.

5. A method of operating a tumbling media mill according to claim 3 wherein the projected total area of such volume or volumes is equivalent to at least about 90% of the area of said enclosure cross-section.

6. A method of operating a tumbling media mill according to claim 3 wherein the projected total area of such volume or volumes is equivalent to substantially the entire area of said enclosure cross-section.

7. A method of operating a tumbling media mill according to claim 1 or 2 including jarring the clumps with said moving member in an entrainment enclosure while rotating said moving member, at least part of said member being rotated within the cross-section of the enclosure for contacting said clumps, and passing said gas current through the enclosure for entraining said finer particles in said gas current.

8. A method of operating a tumbling media mill according to claim 7, including increasing and decreasing the rotational speed of the member for adjusting the proportion of fine particles liberated from said clumps.

9. A method of operating a tumbling media mill according to claim 1 or 2 including jarring the clumps in an entrainment enclosure which is a duct and with a member rotating within and filling the cross-section of the duct sufficiently for substantially impeding and facilitating the flow of particulate material past said member in said duct as the rotational speed of the member is respectively increased and decreased, and causing the rotational speed of the member to increase and decrease for adjusting the proportion of fine particles liberated from said clumps, while also adjusting the rate at which particles move past said member.

10. A method of operating a tumbling media mill according to claim 1 comprising increasing the quantity of said finer particles removed from the remainder of the feed by increasing at least the jarring intensity or the velocity of said gas current in response to said at least one indicator.

11. A method of operating a tumbling media mill according to claim 1 or 10, comprising increasing the jarring intensity in response to said at least one indicator.

12. A method of operating a tumbling media mill according to claim 1 or 10, comprising increasing the velocity of said gas current in response to said at least one indicator.

13. A method of operating a tumbling media mill according to claim 1 or 10, comprising increasing the jarring intensity and the velocity of said gas current in response to said at least one indicator.

14. A method of operating a tumbling media mill according to claim 1 comprising decreasing the quantity of said finer particles removed from the remainder of the feed by decreasing at least the jarring intensity or the velocity of said gas current in response to said at least one indicator.

15. A method of operating a tumbling media mill according to claim 1 or 14, comprising decreasing the jarring intensity in response to said at least one indicator.

16. A method of operating a tumbling media mill according to claim 1 or 14, comprising decreasing the velocity of said gas current in response to said at least one indicator.

17. A method of operating a tumbling media mill according to claim 1 or 14, comprising decreasing the jarring intensity and the velocity of said gas current in response to said at least one indicator.

18. A method of operating a tumbling media mill according to claim 1 including grinding all or a portion of the remainder of the feed in said grinding chamber to make material of reduced particle size in said bed, bringing said reduced material into contact, in said grinding chamber, with a draft of gas for separating said material from said bed and removing said material from said chamber, and, in response to said at least one indicator, adjusting the relationship between A. the velocity of said gas draft in said chamber and
B. the jarring intensity of said moving member for inhibiting or correcting said developing or existing over-fed or under-fed condition.

19. A method of operating a tumbling media mill according to claim 1 including grinding all or a portion of the remainder of the feed in said grinding chamber to make material of reduced particle size in said bed, bringing said reduced material into contact, in said grinding chamber, with a draft of gas for separating said material from said bed and removing said material from said chamber, and, in response to said at least one indicator, adjusting the relationship between A. the velocity of said gas draft in said chamber and
B. the velocity of said gas current for inhibiting or correcting said developing or existing over-fed or under-fed condition.

20. A method of operating a tumbling media mill according to claim 1 including grinding all or a portion of the remainder of the feed in said grinding chamber to make material of reduced particle size in said bed, bringing said reduced material into contact, in said grinding chamber, with a draft of gas for separating said material from said bed and removing said material from said chamber, and, in response to said at least one indicator, adjusting the relationship between A. the velocity of said gas draft in said chamber,
B. the jarring intensity of said moving member and
C. the velocity of said gas current for inhibiting or correcting said developing or existing over-fed or under-fed condition.

21. A method of operating a tumbling media mill according to claim 1 or 2, including causing the clumps of adherent particles of relatively fine and coarse particle size to descent under the influence of gravity in a duct that is more nearly vertical than horizontal, as said clumps come into jarring contact with said member.

22. A method of operating a tumbling media mill according to claim 21, including causing the clumps of adherent particles of relatively fine and coarse particle size to descend under the influence of gravity in a substantially vertical riser.

23. A method of operating a tumbling media mill according to claim 1 or 2, including causing the clumps of adherent particles of relatively fine and coarse particle size to descend in a duct toward said moving member, for jarring contact therewith, under the influence of gravity and of a counter-current flow of said gas current in said duct.

24. A method of operating a tumbling media mill according to claim 1 or 2, including causing the clumps to contact the jarring member without substantial grinding of the particles.

25. A method of operating a tumbling media mil according to claim 1 or 2, including causing the feed exposed to the jarring member to suffer no more than 25% reduction in weight of ultimate particles in any fifth part of the particle size range of ultimate particles represented in a given sample of the feed prior to exposure to the member.

26. Apparatus for treating particulate solids, comprising:

A. a tumbling media mill having a grinding chamber rotatable to tumble a bed of grinding media and particulate solids, said chamber having a solids inlet and a solids outlet,
B. a clump separator for receiving and preparing feed material to be ground in said tumbling media mill grinding chamber, said clump separator including
   1. an enclosure,
   2. at least one jarring member, at least part of which extends into said enclosure for moving in said enclosure, said member having at least one material contacting component for jarring at a selected jarring intensity a feed comprising clumped relatively fine and coarse particulate solids and for liberating fine particles from the clumps, and
   3. a coarse solids outlet connected, directly or indirectly, with the tumbling media mill grinding chamber solids inlet for delivering coarse particulate solids to said chamber,
C. means for removing liberated fine particulate solids from said enclosure by a path other than said coarse solids outlet,
D. indicator means for sensing a developing or existing over-fed or under-fed condition in said bed, and
E. means responsive to said indicator means for increasing and decreasing the quantity of fine particles removed from said enclosure via said path.

27. Apparatus for treating particulate solids according to claim 26 wherein said means responsive to said indicator means includes means for adjusting the jarring intensity of said jarring member.

28. Apparatus for treating particulate solids according to claim 26 wherein said jarring member extends into an enclosure which is a duct that includes means for entrainment of said liberated fine particulate solids and for removing said entrained solids along said path.

29. Apparatus for treating particulate solids according to claim 26 wherein said at least part of said jarring member is positioned in said enclosure for causing said at least one material contacting component to traverse, during motion of said jarring member, at least one predetermined volume of the space within the enclosure, and wherein the total area of the volume or volumes so traversed, when projected upon a plane through said enclosure in which said jarring member is located, said plane being perpendicular to the overall direction of motion of material through the enclosure, is equivalent to at least the majority of the total cross-sectional area of the enclosure in the same plane.

30. Apparatus for treating particulate solids according to claim 26 wherein said means responsive to said indicator means includes means for adjusting the velocity of a gas current moving through said enclosure for entraining liberated fine particles.

31. Apparatus for treating particulate solids according to claim 30 wherein said duct is a riser that is more nearly vertical than horizontal.

32. Apparatus for treating particulate solids according to claim 26 wherein said means responsive to said indicator means includes means for adjusting the jarring intensity of said jarring member and means for adjusting the velocity of a gas current moving through said enclosure for entraining liberated fine particles.

33. Apparatus for treating particulate solids according to claim 31 wherein said path extends through a portion of the riser that is above said member and said coarse solids outlet of said riser is positioned below said jarring member.

34. Apparatus for treating particulate solids according to claim 31 wherein said riser is substantially vertical.

35. Apparatus for treating particulate solids according to claim 34 wherein the projected total area of such volume or volumes is equivalent to at least about 80% of the area of said enclosure cross-section.

36. Apparatus for treating particulate solids according to claim 34 wherein the projected total area of such volume or volumes is equivalent to at least about 90% of the area of said enclosure cross-section.

37. Apparatus for treating particulate solids according to claim 34 wherein the projected total area of such volume or volumes is equivalent to substantially the entire area of said enclosure cross-section.

38. Apparatus for treating particulate solids, comprising:

A. a tumbling media mill having a grinding chamber rotatable to tumble a bed of grinding media and particulate solids, said grinding chamber having a solids inlet and a solids outlet, B. an elongated entrainment duct to receive a feed of relatively fine and coarse particulate solids, including clumps comprising said fine and coarse solids, and to prepare therefrom a charge to be introduced into said tumbling media mill chamber to be ground therein, said duct having a solids inlet for said solids, C. a clump separator including a jarring member, at least part of which is positioned in said duct, said part being positioned in a portion of said duct which is spaced apart from and below said solids inlet, to receive said solids by gravity descent from said solids inlet and to separate fine and coarse solids from said clumps, said clump separator including means for increasing and decreasing the jarring intensity of the jarring member for adjusting the proportion of fine particles liberated from said clumps, D. at least one entrainment gas supply conduit having a connection with said duct, said connection being positioned in said duct and spaced apart from and below said solids inlet, and E. means connected with said conduit for maintaining an upwardly flowing gas current through that portion of the duct which includes said part of said jarring member and through that portion of the duct which includes said solids inlet, for causing gravity descent in said duct of clumps from said solids inlet and of coarse particles from said jarring member, for entraining in said duct fine particles liberated from said clumps by said clump separator, for lifting said liberated fine particles in said duct toward said solids inlet, for bringing other fine particles of feed into entrainment with said liberated fine particles adjacent said solids inlet and for lifting the resultant mixture of liberated and other fine particles above said solids inlet.

39. Apparatus for treating particulate solids according to claim 38 wherein the duct is substantially vertical.

40. Apparatus for treating particulate solids according to claim 26 or 38 wherein said jarring member is a rotating member.

41. Apparatus for treating particulate solids according to claim 40 including means for increasing and decreasing the rotational speed of the rotating member for adjusting the proportion of fine particles liberated from said clumps.

42. Apparatus for treating particulate solids according to claim 40 wherein said member rotates within and fills the cross-section of the duct sufficiently for impeding or facilitating the flow of particulate material past said member in said duct as the rotational speed of the member is increased and decreased, while adjusting the proportion of fine particles liberated from said clumps and the rate at which particulate move past said member.

* * * * *